US007107638B2

(12) United States Patent
Wilson

(10) Patent No.: US 7,107,638 B2
(45) Date of Patent: Sep. 19, 2006

(54) THERMALLY-ADAPTIVE COMFORTER WITH AESTHETIC DESIGN VARIABILITY

(76) Inventor: Thais Wilson, P.O. Box 38003, Tallahassee, FL (US) 32315

( * ) Notice: Subject to any disclaimer, the term of this patent is extended or adjusted under 35 U.S.C. 154(b) by 0 days.

(21) Appl. No.: 11/018,452

(22) Filed: Dec. 21, 2004

(65) Prior Publication Data

US 2006/0130235 A1 Jun. 22, 2006

(51) Int. Cl.
*A47G 9/02* (2006.01)
*A47G 9/04* (2006.01)

(52) U.S. Cl. ..... 5/502; 5/482; 5/923

(58) Field of Classification Search ..... 5/482, 5/502, 500, 486, 923; 128/854, 849, 853
See application file for complete search history.

(56) References Cited

U.S. PATENT DOCUMENTS 2,808,596 A * 10/1957 Schreiner ..... 5/486
3,120,721 A 2/1964 Bukatman
3,325,832 A * 6/1967 Malicki ..... 5/487
3,799,161 A * 3/1974 Collins ..... 128/854
3,826,253 A * 7/1974 Larsh et al. ..... 128/854
4,631,765 A 12/1986 Casey
4,890,347 A 1/1990 Fuller
4,949,415 A 8/1990 Selga
5,118,553 A 6/1992 Boisson
D378,969 S 4/1997 Roan
5,664,269 A 9/1997 Broder
5,898,962 A 5/1999 McNeal
D434,590 S 12/2000 Faulklander
6,557,192 B1 5/2003 Zheng
6,640,362 B1 11/2003 Kimball
6,684,422 B1 2/2004 LeFevre
6,934,985 B1 * 8/2005 Sanders ..... 5/482

* cited by examiner

*Primary Examiner*—Alexander Grosz
(74) *Attorney, Agent, or Firm*—John Wiley Horton

(57) ABSTRACT

A thermally-adaptive comforter which gives the user a greater amount of control over the temperature of their sleeping environment. The invention accomplishes this objective by providing a comforter with hatches which allows the user to vary the thermal conductivity of the comforter in certain areas. The comforter includes a plurality of hatch covers, having different colors or designs, which are placed over hatch openings. The hatch covers are detachably fastened to the comforter so that the hatch covers may be rearranged to change the appearance of the comforter. This feature of aesthetic design variability allows the user to change the appearance of the comforter as desired.

9 Claims, 10 Drawing Sheets

THERMALLY-ADAPTIVE COMFORTER WITH AESTHETIC DESIGN VARIABILITY

BACKGROUND OF THE INVENTION

1. Field of the Invention

This invention relates to the field of blankets and bedding. More specifically, the invention comprises a comforter with detachable hatches which provides enhanced temperature control and aesthetic design variability.

2. Description of the Related Art

The human body generates a substantial amount of heat. Humans have long since taken advantage of this source of energy for comfort by using blankets and clothes to insulate the body and prevent the rapid loss of body heat to the environment. Those skilled in the art know the rate of conductive heat transfer is directly proportional to the thermal conductivity of the object through which heat is conducted. Heat transfer can therefore be slowed by using insulation with a lower conductivity. In terms of bedding materials, one can use thicker blankets or blankets with lower thermal conductivity, like down comforters.

Quilts, comforters, and blankets are widely used bedding materials that generally serve to insulate a sleeper from cooler ambient conditions and provide a more comfortable condition for sleeping. When not in use, these bedding materials often serve a decorative function as the pattern and color scheme chosen represent one's design taste.

Prior art bedding materials, however, have various limitations. Conventional comforters provide a constant, inadaptable amount of insulation. For some individuals it is difficult to achieve the desired temperature condition by adding or removing blankets. For example, one blanket might provide too little insulation while two blankets might provide too much. In addition, in beds shared by multiple occupants, each occupant may desire to sleep at a different temperature or have a different amount of insulation.

It is therefore desirable to provide a bedding material with adaptable insulation that can accommodate the desired temperature conditions for multiple bed occupants. In addition, it is likewise desirable to provide a bedding material with changeable aesthetic design characteristics.

BRIEF SUMMARY OF THE INVENTION

The present invention is a thermally-adaptive comforter with hatches provided for ventilation. The amount of insulation the comforter provides can be adjusted by adding or removing hatch covers, thereby giving the user a greater amount of control over temperature. In addition, the user can change the hatch covers occasionally to change the comforter's appearance.

Another embodiment of the invention provides a comforter with semi-detachable hatch covers ventilation. This embodiment allows the user to have greater control of the temperature under the comforter while preventing the hatch covers from becoming separated and potentially lost.

The invention provides all of these features, advantages, and objects along with others that will become apparent with reference to the following description and accompanying drawings.

REFERENCE NUMERALS IN THE DRAWINGS

| | | | |
|---|---|---|---|
| 10 | comforter | 12 | hatch |
| 14 | hatch opening | 16 | VELCRO hooks |
| 18 | VELCRO loops | 20 | snaps |
| 22 | sewn edge | 24 | hatch cover |

DETAILED DESCRIPTION OF THE INVENTION

The present invention provides a thermally-adaptive comforter which gives the user a greater amount of control over the temperature of his or her sleeping environment. The invention accomplishes this objective by providing a comforter with user-variable hatches.

Figure 1:
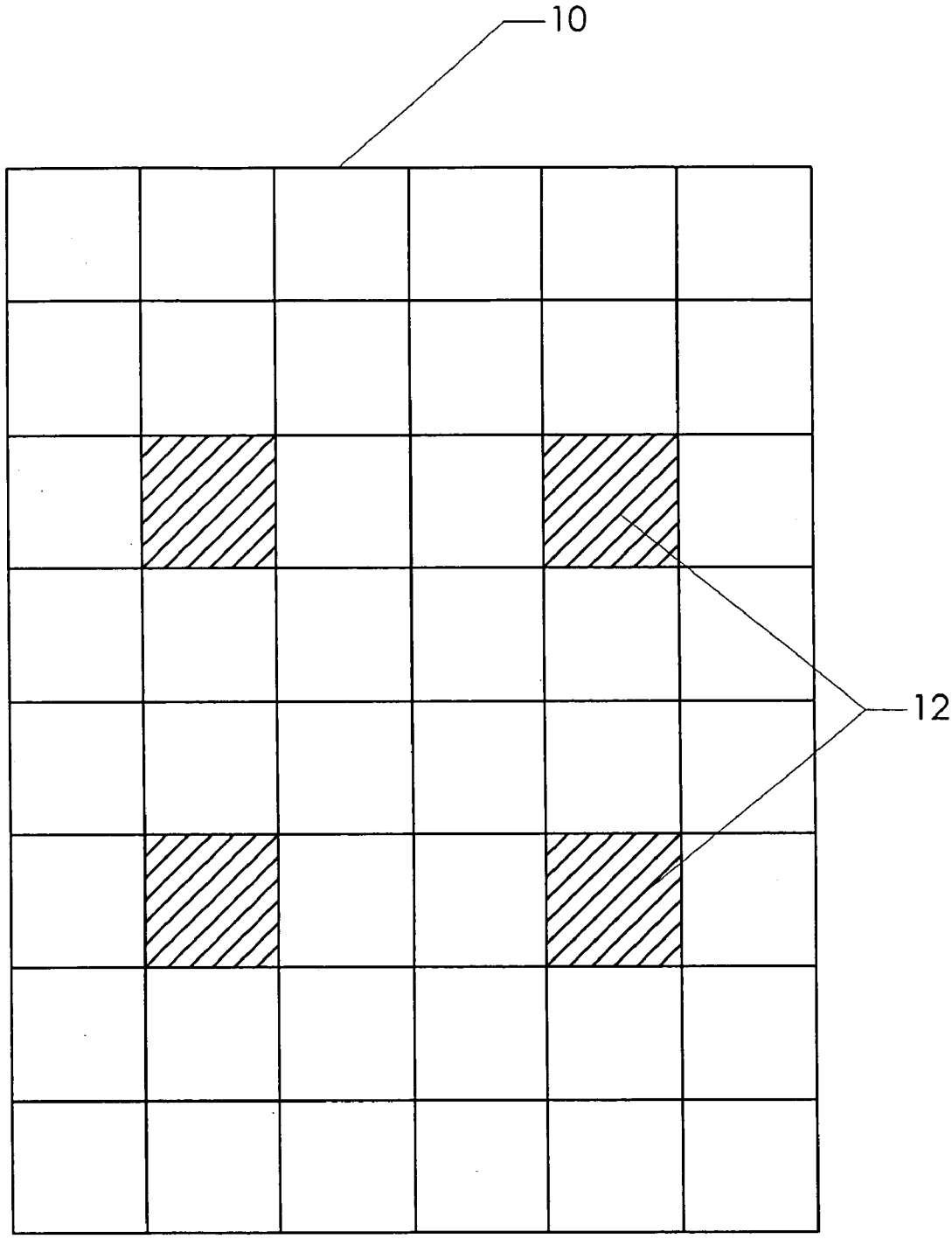
FIG. 1 is a perspective view, showing the present invention.

A thermally-adaptive comforter is shown in FIG. 1. Comforter 10 features a multitude of hatches 12 in the top layer of the blanket. Comforter 10 can be any type of blanket. Common examples of comforters include those fabricated with a top and bottom layer such as patchwork quilts and down comforters; however, comforter 10 can also be a single-layered blanket.

Figure 2:
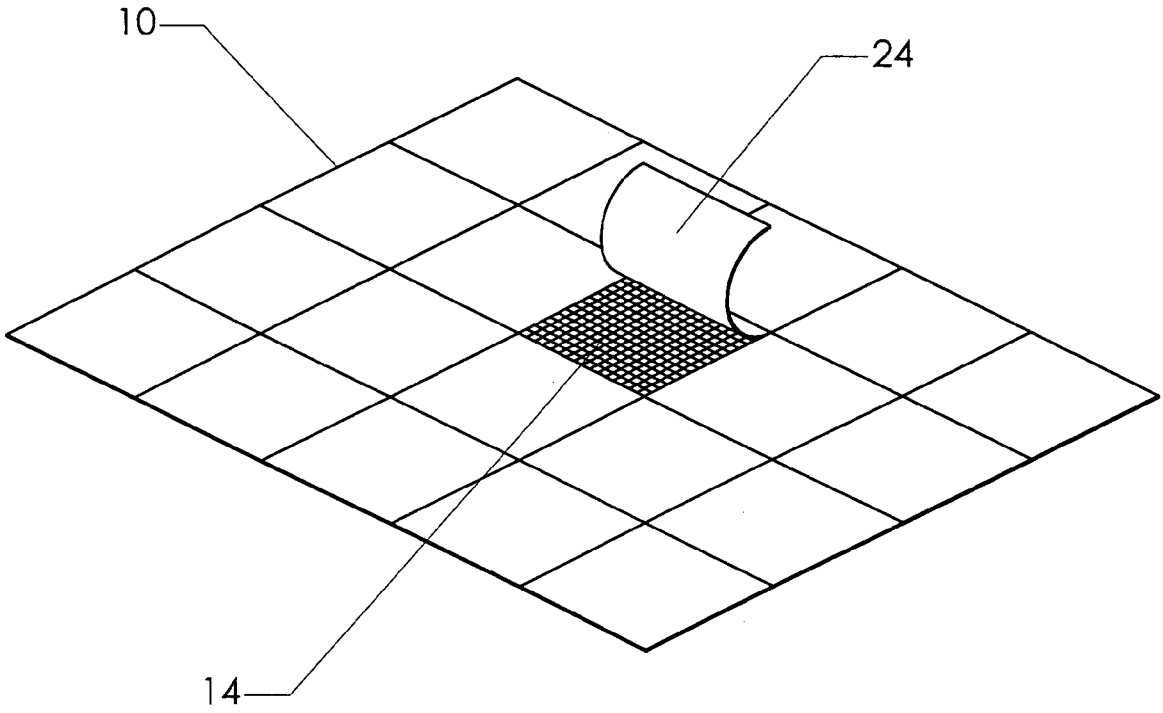
FIG. 2 is a perspective view, showing the present invention.

FIG. 2 shows the component parts of the hatches and comforter. Each hatch is composed of a hatch cover 24 and a hatch opening 14. Hatch cover 24 can be made of the same material as the top layer of comforter 10, or it may be made of a dissimilar material.

Hatch cover 24 of comforter 10 is shown in the pulled back position to reveal hatch opening 14. When hatch cover 24 is pulled back as shown, the insulation provided to that area of the bed is reduced and heat will therefore transfer more rapidly through the area. In this illustration, hatch opening 14 is filled by the bottom layer of comforter 10, but other materials could also be used. Examples of other materials that can be used for hatch opening 14 include mesh and thin, breathable sheets. Mesh describes any of a variety of textiles in which the woven fibers comprise less than half the total surface area. Thin, breathable sheets include sheets made of cotton, synthetic materials, and combinations of such materials which are permeable. Heat transfer is enhanced in these materials by both the increased conductive heat transfer resulting from the reduction of insulation and increased convective heat transfer resulting from the increased air current. It is also noted that hatch opening 14 can be void of material to allow maximum ventilation.

Hatches 12 can be spread out over the comforter as shown in FIG. 1 to provide local zones of temperature control.

Figure 3:
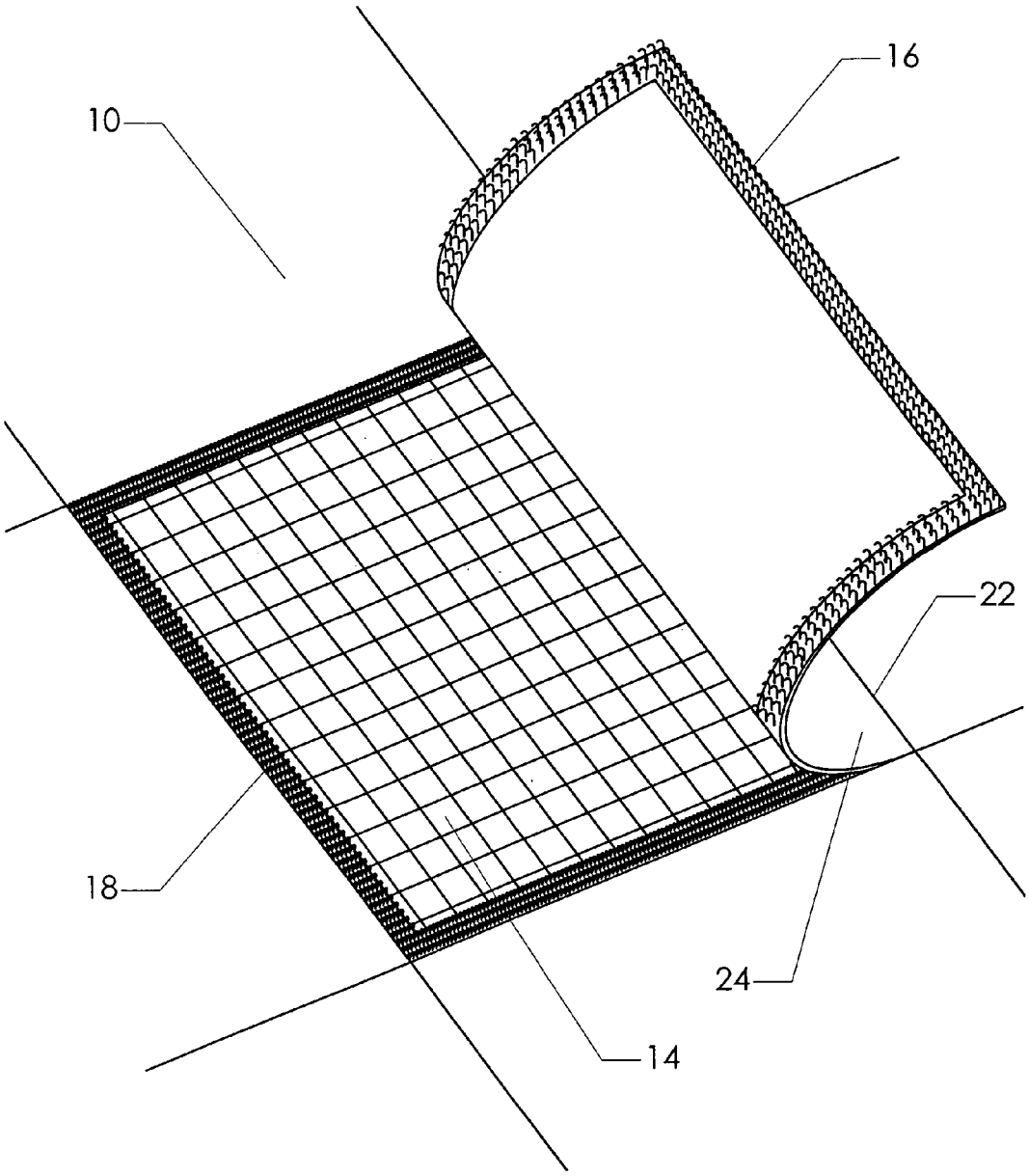
FIG. 3 is a perspective view, showing the present invention with hook-and-loop fasteners.

One way to attach the hatch cover to the comforter is shown in FIG. 3. Hatch cover 24 has sewn edge 22 which is sewn to comforter 10. The other three edges of hatch cover 24 have VELCRO hooks 16 which mate with VELCRO loops 18 on hatch opening 14 when hatch cover 24 is closed (the hooks and loops can obviously be reversed).

Figure 4:
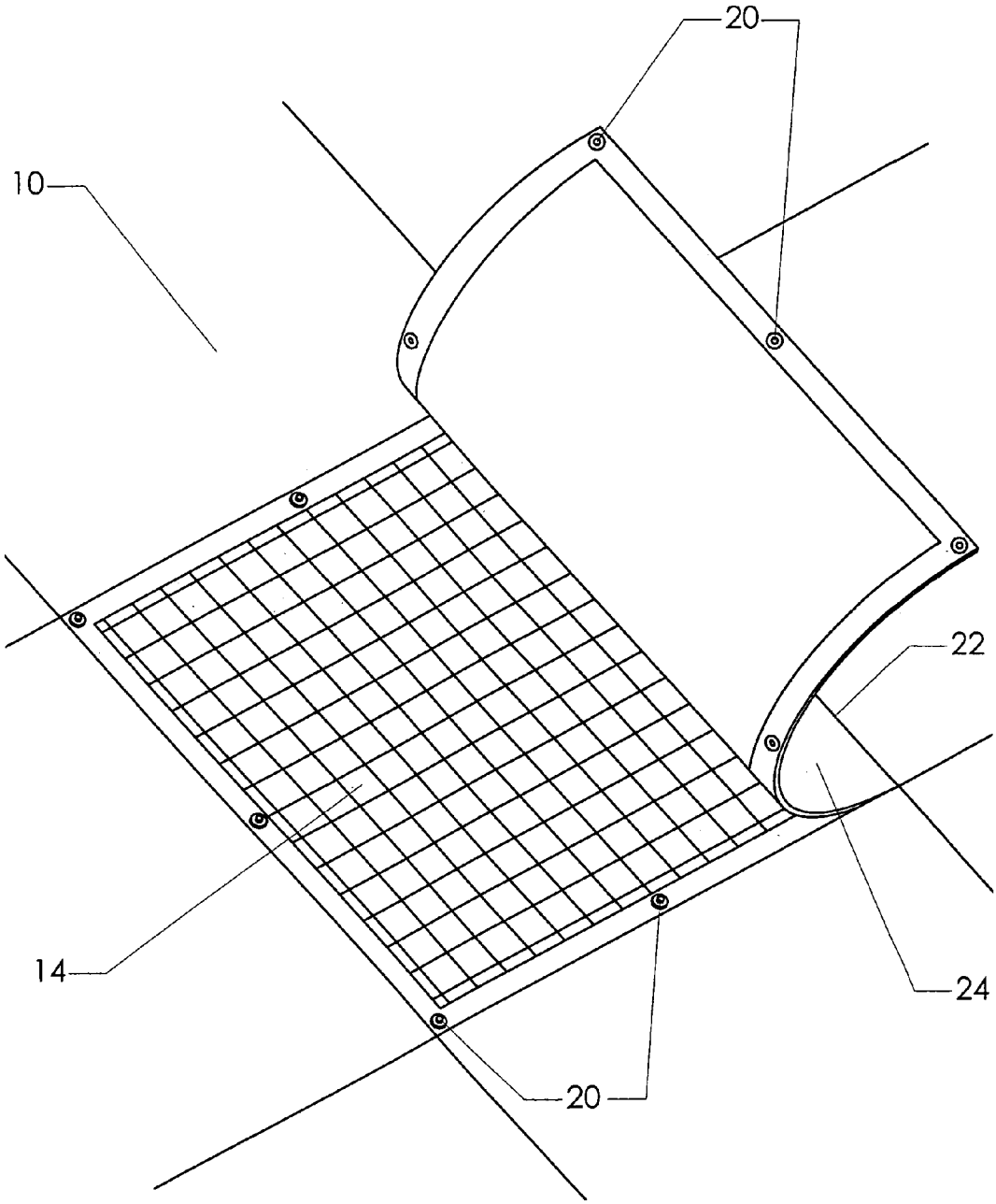
FIG. 4 is a perspective view, showing the present invention with snap fasteners.

An alternate means of fastening the hatch cover to the comforter is shown in FIG. 4. Hatch cover 24 has sewn edge 22 which is sewn to comforter 10. The other three edges of hatch cover 24 have snaps 20 which mate with their counterpart snaps 20 on hatch opening 14 when hatch cover 24 is closed. Other types of fasteners, like buttons and zippers, can also be used to fasten the hatches and are common in the prior art.

Figure 5:
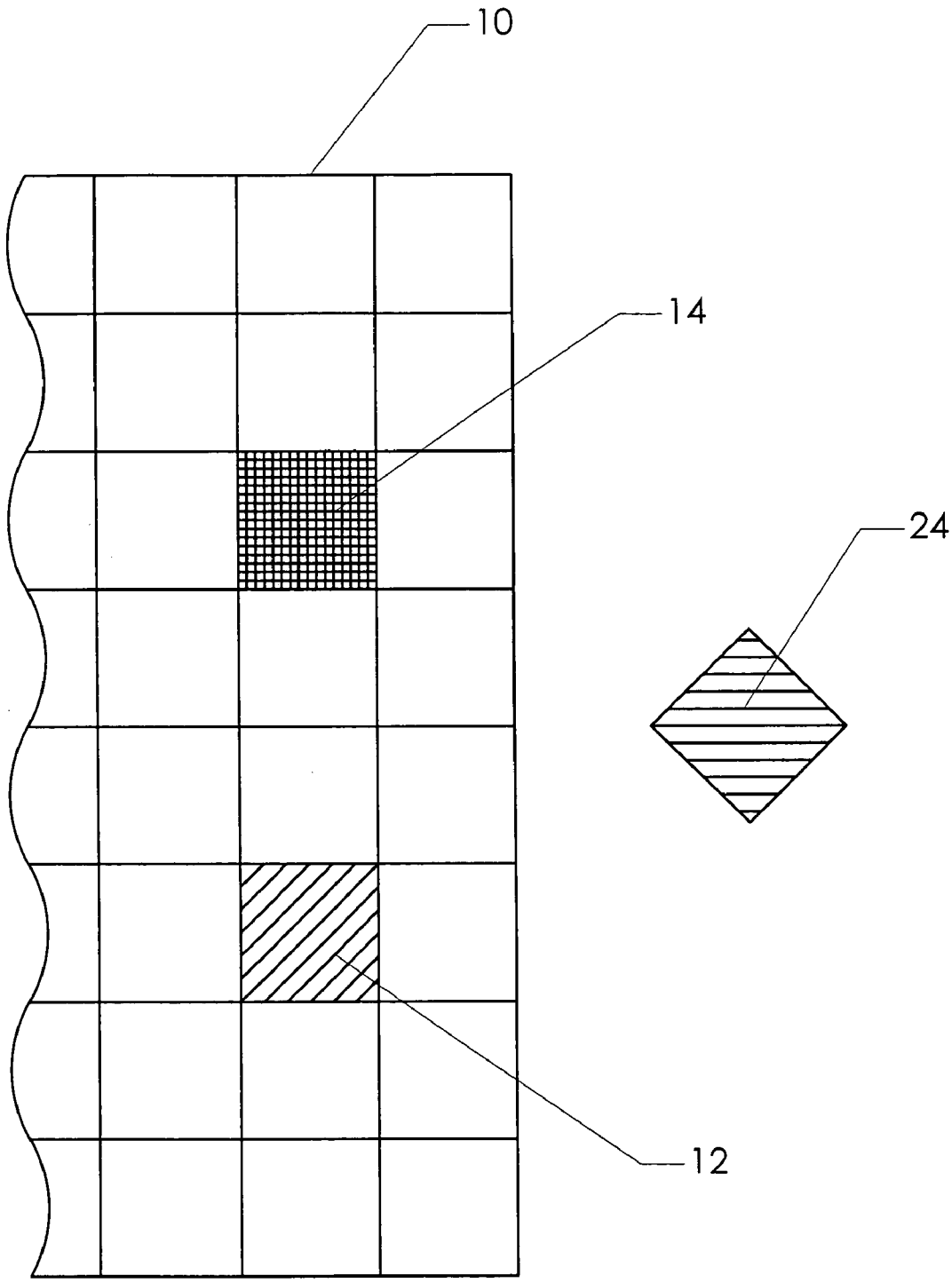
FIG. 5 is a perspective view, showing an alternate embodiment of the present invention.

An alternate embodiment with completely detachable hatch covers is shown in FIG. 5. The version of comforter 10 depicted in FIG. 5 features completely detachable hatch covers 24. Hatch cover 24 is made completely detachable by removal of sewn edge 22, shown in FIGS. 3 and 4. Either VELCRO hooks 16 and VELCRO loops 18 or snaps 20 can be used in the place of sewn edge 22 to facilitate the connection of the edge to the blanket. When hatch cover 24 is removed, hatch opening 14 is left exposed as shown in FIG. 5, and the diminished insulation in the area promotes heat transfer. Furthermore, the user can replace hatch covers 24 with hatch covers of other color or design to change the appearance of comforter 10.

Figure 6:
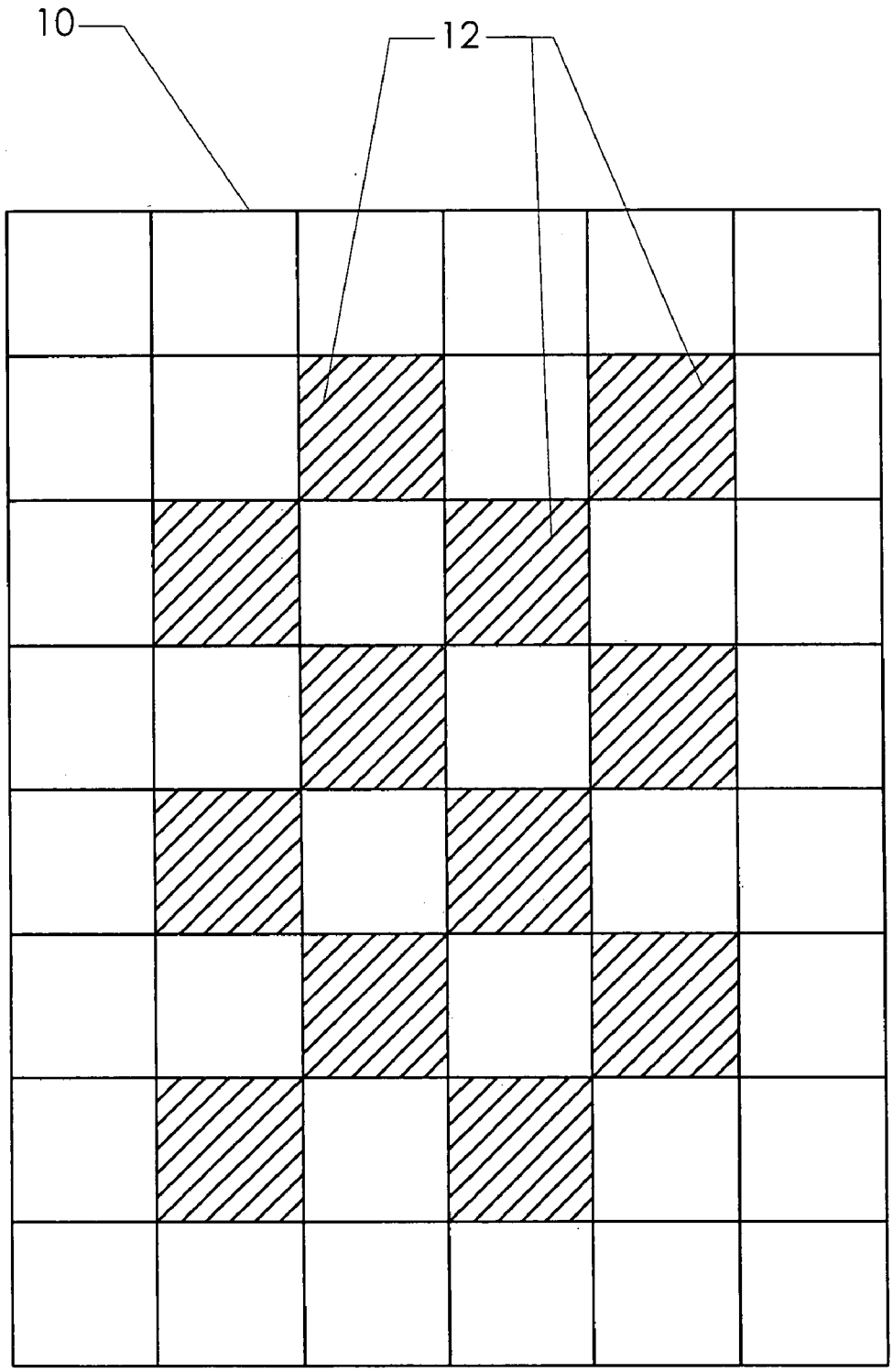
FIG. 6 is a perspective view, showing a design of the present invention.

Another embodiment is shown in FIG. 6. Comforter 10 has hatches 12 staggered in a "checkerboard" formation. The hatch covers can be completely detachable so that the appearance of comforter 10 could be substantially changed by replacement of the hatch covers with hatch covers of other colors or designs.

Figure 7:
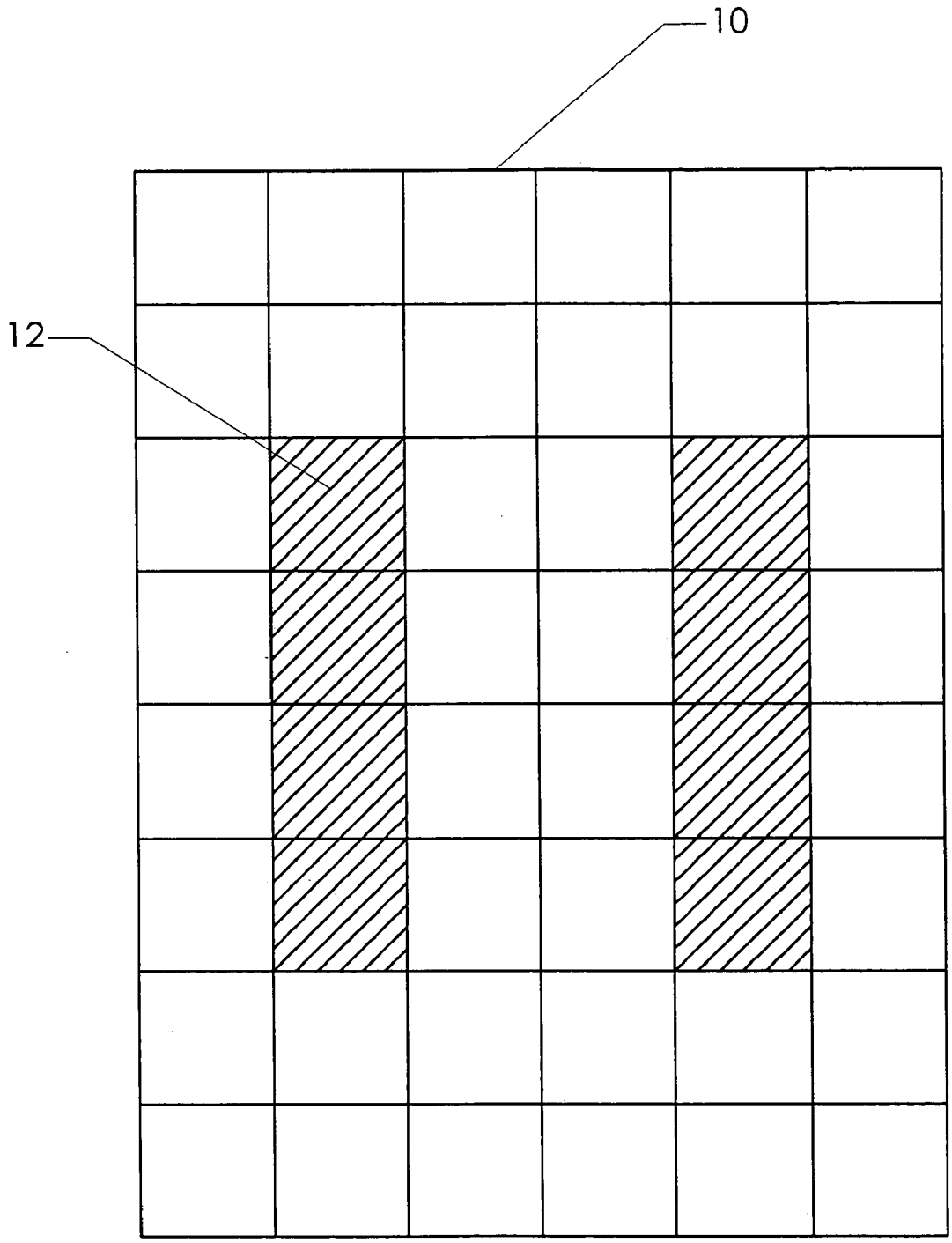
FIG. 7 is a perspective view, showing an alternate embodiment of the present invention.
Figure 8:
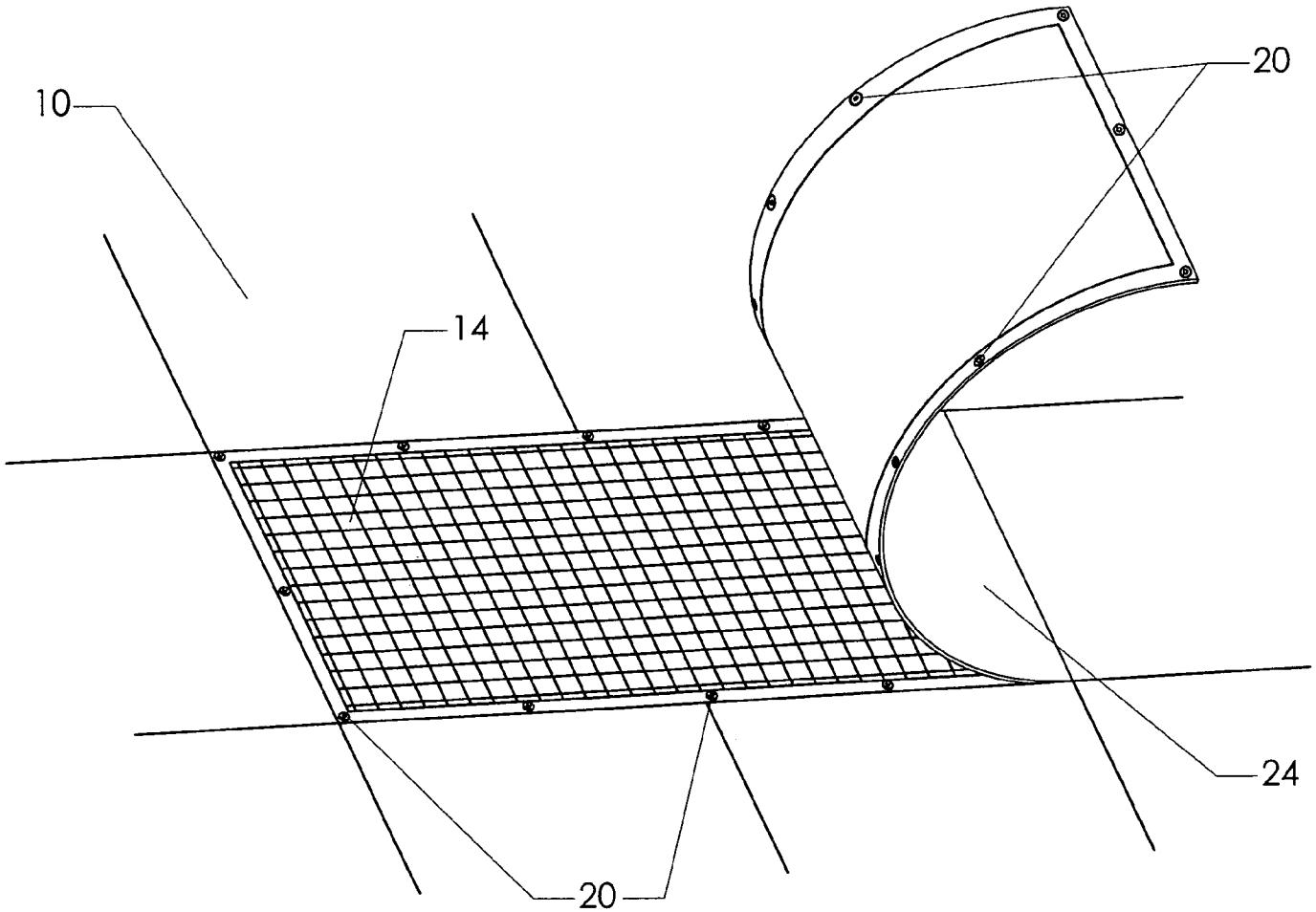
FIG. 8 is a perspective view, showing an alternate embodiment of the present invention.

Yet another alternate version of the comforter and hatch is shown in FIG. 7. Comforter 10 has hatches 12 which have a length significantly greater than their width. This design allows hatch cover 24 to be incrementally adjusted as shown in FIG. 8 to provide the desired ventilation. The component parts of the alternate hatch are illustrated in FIG. 8. Hatch cover 24 and hatch opening 14 have snaps 20 along their edges which enables hatch 12 to be opened to variable lengths, each length providing a different amount of ventilation.

Figure 9:
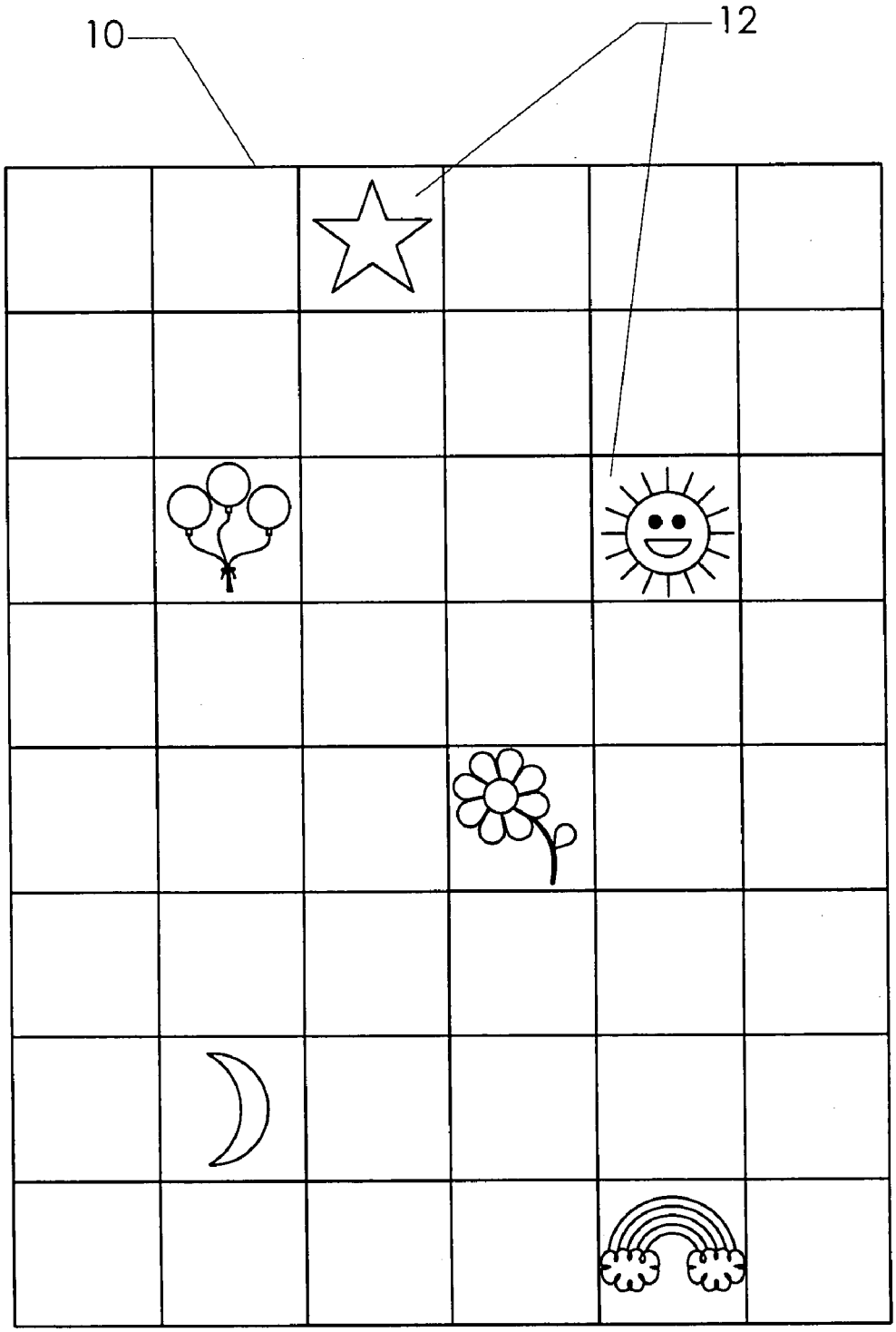
FIG. 9 is a perspective view, showing an alternate embodiment of the present invention.

Another variation of the invention is shown in FIG. 9. Hatches 12 have decorative hatch covers of various designs. Balloons, stars, suns, flowers, moons, and rainbows are shown but any desirable design could be used, including a child's name or seasonal designs.

As illustrated in FIG. 9, hatch covers 24 may be provided in different colors or designs. Because hatch covers 24 are completely detachable from comforter 10, the reader will appreciate that hatch covers 24 may be rearranged to change the appearance of comforter 10. The reader will appreciate that this feature of aesthetic design variability allows the user to attach replacement hatch covers whenever a change of appearance is desired. In the example where a child's name is used, the user may remove the hatch covers corresponding to one child's name and replace the old hatch covers with new hatch covers corresponding to another child's name. In the example of seasonal designs, the user may replace hatch covers featuring fall designs with hatch covers featuring winter designs as the season changes from fall to winter.

Figure 10:
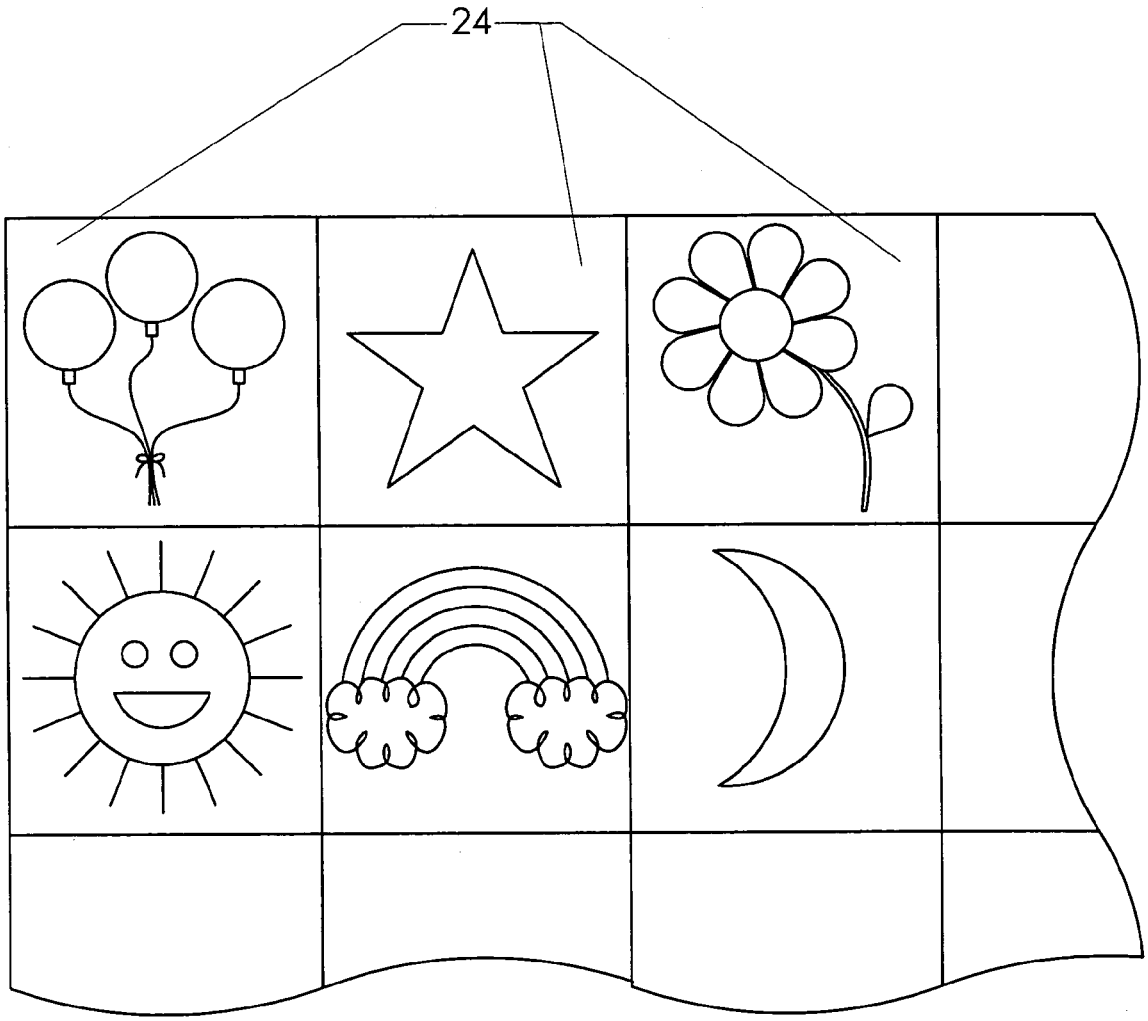
FIG. 10 is a perspective view, showing an alternate embodiment of the present invention.

In all the previous drawings the hatches have been spaced out across the comforter. FIG. 10 shows a comforter covered by hatches in its entirety. Hatch covers 24 can either be completely detachable or partially detachable as described above.

The preceding description contains significant detail regarding the novel aspects of the present invention. It is should not be construed, however, as limiting the scope of the invention but rather as providing illustrations of the preferred embodiments of the invention. As an example, many types of fasteners can be used in place of VELCRO hooks 16, VELCRO loops 18, and snaps 20 including button-and-loop fasteners and zippers. Such a variation would not alter the function of the invention. Additionally, hatch openings 14 are illustrated in the drawings as having a mesh backing, but the openings can be made of any material or no material at all without changing the function of the invention. Thus, the scope of the invention should be fixed by the following claims, rather than by the examples given.

I claim:

1. A comforter with a plurality of hatches comprising:

a. a plurality of hatch covers, having different colors or designs, wherein each of said plurality of hatch covers is detachably fastened to said comforter;

b. a plurality of hatch openings, each of said plurality of hatch openings comprising some material;

c. an attachment means for attaching said plurality of hatch covers to said comforter, said attachment means configured to allow rearrangement of said plurality of hatch covers to change the appearance of said comforter;

d. wherein each of said plurality of hatch covers is configured to cover at least one of said plurality of hatch openings when said hatch cover is detachably fastened to said comforter; and e. wherein each of said plurality of hatch covers is completely detachable from said comforter such that said hatch cover may be removed from said comforter and a replacement hatch cover may be detachably fastened to said comforter over said hatch opening in place of said hatch cover thereby changing the appearance of said comforter.

2. The hatch of claim 1, wherein each of said plurality of hatch openings comprises mesh.

3. The hatch of claim 1, wherein each of said plurality of hatch openings comprises a permeable, fibrous material.

4. A thermally-adaptive comforter comprising:

a. a bottom layer;

b. a top layer, being fabricated to said bottom layer;

c. a plurality of hatch covers, having different colors or designs, detachably fastened to said top layer such that each of said plurality of hatch covers is readily removable from said comforter;

d. a plurality of hatch openings, each of said hatch openings comprising some material;

e. an attachment means for attaching said plurality of hatch covers to said comforter, said attachment means configured to allow rearrangement of said plurality of hatch covers to change the appearance of said comforter;

f. wherein each of said plurality of hatch covers is configured to cover at least one of said plurality of hatch openings when said hatch cover is detachably fastened to said comforter; and g. wherein each of said plurality of hatch covers is completely detachable from said comforter such that said hatch cover may be removed from said comforter and a replacement hatch cover may be detachably fastened to said comforter over said hatch opening in place of said hatch cover thereby changing the appearance of said comforter.

5. The thermally-adaptive comforter of claim 4, wherein each of said plurality of hatch openings comprises mesh.

6. The thermally-adaptive comforter of claim 4, wherein each of said plurality of hatch openings comprises a permeable, fibrous material.

7. A thermally-adaptive comforter comprising:

a. a bottom layer;

b. a top layer, being fabricated to said bottom layer;

c. a plurality of hatch openings, each of said hatch openings comprising some material spanning said hatch opening;

d. a plurality of hatch covers, having different colors or designs, each of said plurality of hatch covers detachably fastened to said comforter and readily removable from said comforter, each of said plurality of hatch covers covering at least one of said plurality of hatch openings when said hatch cover is detachably fastened to said comforter;

e. an attachment means for attaching said plurality of hatch covers to said comforter, said attachment means configured to allow rearrangement of said plurality of hatch covers to change the appearance of said comforter;

f. wherein each of said plurality of hatch covers is configured to cover at least one of said plurality of hatch openings when said hatch cover is detachably fastened to said comforter; and g. wherein each of said plurality of hatch covers is completely detachable from said comforter such that said hatch cover may be removed from said comforter and a replacement hatch cover may be detachably fastened to said comforter over said hatch opening in place of said hatch cover thereby changing the appearance of said comforter.

8. The thermally-adaptive comforter of claim 7, wherein each of said plurality of hatch openings comprises mesh.

9. The thermally-adaptive comforter of claim 7, wherein each of said plurality of hatch openings comprises a permeable, fibrous material.

* * * * *